US008671810B2

(12) United States Patent
Sandahl

(10) Patent No.: US 8,671,810 B2
(45) Date of Patent: Mar. 18, 2014

(54) FOLDER FOR ADJUSTABLY TENSIONING A WEB AS THE WEB IS CUT

(75) Inventor: Kyle Albert Sandahl, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/330,240

(22) Filed: Dec. 19, 2011

(65) Prior Publication Data

US 2012/0085213 A1 Apr. 12, 2012

Related U.S. Application Data

(62) Division of application No. 12/313,341, filed on Nov. 19, 2008, now Pat. No. 8,100,038.

(51) Int. Cl.
*B26D 1/36* (2006.01)

(52) U.S. Cl.
USPC ..... 83/110; 83/165; 83/346

(58) Field of Classification Search
USPC ..... 83/18, 26, 110, 343, 120, 154, 156, 346
See application file for complete search history.

(56) References Cited

U.S. PATENT DOCUMENTS

| | | | | |
|---|---|---|---|---|
| 1,331,727 | A | | 2/1920 | Seymour |
| 4,218,053 | A | | 8/1980 | Heimlicher |
| 4,392,844 | A | * | 7/1983 | Fulk et al. ..... 493/399 |
| 4,779,781 | A | | 10/1988 | Billberg et al. |
| 4,946,151 | A | | 8/1990 | Liebert |
| 5,024,128 | A | | 6/1991 | Campbell, Jr. |
| 5,096,174 | A | | 3/1992 | Nishihara |
| 5,103,703 | A | | 4/1992 | Littleton |
| 5,193,423 | A | | 3/1993 | Bakker |
| 5,520,383 | A | | 5/1996 | Amagai et al. |
| 5,641,156 | A | | 6/1997 | Nukada et al. |
| 5,695,105 | A | | 12/1997 | Ohara |
| 5,794,927 | A | | 8/1998 | Uchida |
| 6,055,896 | A | | 5/2000 | Molison |
| 6,086,694 | A | | 7/2000 | Winter |
| 6,170,371 | B1 | | 1/2001 | Cote et al. |
| 6,170,820 | B1 | | 1/2001 | Hutson |
| 6,533,212 | B1 | | 3/2003 | Tafel, II |
| 6,604,444 | B1 | | 8/2003 | Belanger et al. |
| 6,687,570 | B1 | | 2/2004 | Sussmeier et al. |
| 6,761,676 | B2 | | 7/2004 | Wingate et al. |
| 7,007,602 | B2 | | 3/2006 | Kiyota |
| 7,326,161 | B2 | | 2/2008 | Isikawa |
| 2003/0033915 | A1 | | 2/2003 | Glemser et al. |
| 2007/0018373 | A1 | | 1/2007 | Shoji et al. |
| 2007/0135287 | A1 | | 6/2007 | Morelli et al. |
| 2008/0001339 | A1 | | 1/2008 | Tahara |

FOREIGN PATENT DOCUMENTS

| | | |
|---|---|---|
| WO | 99/57050 | 11/1999 |

* cited by examiner

*Primary Examiner* — Kenneth E. Peterson
(74) *Attorney, Agent, or Firm* — Davidson, Davidson & Kappel, LLC

(57) ABSTRACT

A printing press folder is provided. The printing press folder includes a cutting apparatus cutting a moving web to form successive signatures, a first acceleration cylinder and a second acceleration cylinder. The first acceleration cylinder includes a first contacting segment and a first relieved portion circumferentially adjacent to the first contacting segment. The second acceleration cylinder includes a second contacting segment and a second relieved portion circumferentially adjacent to the second contacting segment. The first acceleration cylinder and the second acceleration cylinder grip the web at a gripping location with the first contacting segment and the second contacting segment as the web is cut by the cutting apparatus.

9 Claims, 2 Drawing Sheets

FOLDER FOR ADJUSTABLY TENSIONING A WEB AS THE WEB IS CUT

CROSS REFERENCE TO RELATED APPLICATIONS

This is a divisional application of U.S. application Ser. No. 12/313,341 filed Nov. 19, 2008, now U.S. Pat. No. 8,100,038 the entire disclosure of which is hereby incorporated by reference herein.

The present invention relates to a folder for a rotary printing press for adjustably tensioning a web and a method of adjusting web tension in a web as a web is cut.

BACKGROUND

U.S. Pat. No. 5,103,703 discloses a sheet cutting apparatus for severing a rapidly-moving web, such as printed paper, into cut sheets in two stages. In the first stage, spaced cuts are made along a transverse cutting line of the web. The web is trained between belts which support the cut portions of the web, and the uncut portions of the web are severed to separate sheets. The sheets are conveyed out of the cutting station and into further apparatus. Preferably, the belts for supporting the web during the second cutting operation are trained around the knife and anvil rolls which make the cuts. The purpose of the belts is to prevent the leading edge of the web or a cut sheet from being projected forward of its support, thus tending to become dog-eared or misfed. The cuts made at the first and second cutting stations can be arranged in various patterns to remedy mis-timing of the respective cutting stations.

U.S. Pat. No. 5,695,105 discloses an apparatus for cutting a web at a predetermined length and supplying the same. A cutting roller is provided on its peripheral surface with projecting cutting blades arranged at predetermined intervals circumferentially and extending axially out of the cutting roller. The cutting blades are pressed against the peripheral surface of the receiving roller so as to cut the portion of the web which has passed between the cutting and receiving rollers at a predetermined length. At the downstream side of the cutting means there is provided accelerating means which has a pair of accelerating rollers sandwiching the web and sending the web in the transporting direction at a speed slightly higher than the speed which the cutting means provides.

U.S. Publication No. 2007/0018373 discloses a folder including a cut-off unit capable of varying and cutting a cut-off length of a web fed from a printing machine of the rotary printing machine, and a processor (such as a folder, etc.) for processing a sheet cut off by the cut-off unit. Between the cut-off unit and the processor, the folding machine further includes a first belt conveyor for conveying the sheet at a speed equal to the web, and a second belt conveyor for receiving the sheet from the first belt conveyor at a speed approximately equal to the sheet conveying speed of the first belt conveyor, then varying the conveying speed to a speed approximately equal to the sheet conveying speed of the processor, and delivering the sheet to processor.

SUMMARY OF THE INVENTION

A printing press folder is provided. The printing press folder includes a cutting apparatus cutting a moving web to form successive signatures, a first acceleration cylinder and a second acceleration cylinder. The first acceleration cylinder includes a first contacting segment and a first relieved portion circumferentially adjacent to the first contacting segment and the first contacting segment radially protrudes from the first acceleration cylinder with respect to the first relieved portion. The second acceleration cylinder includes a second contacting segment and a second relieved portion circumferentially adjacent to the second contacting segment and the second contacting segment radially protrudes from the second acceleration cylinder with respect to the second relieved portion. The first acceleration cylinder and the second acceleration cylinder grip the web at a gripping location with the first contacting segment and the second contacting segment to create a tension in the web as the web is cut by the cutting apparatus.

A method of varying tension in a web in a printing press folder is also provided. The method includes the steps of providing a first acceleration cylinder including a first contacting segment and a first relieved portion circumferentially adjacent to the first contacting segment, the first contacting segment radially protruding from the first acceleration cylinder with respect to the first relieved portion, and a second acceleration cylinder including a second contacting segment and a second relieved portion circumferentially adjacent to the second contacting segment, the second contacting segment radially protruding from the second acceleration cylinder with respect to the second relieved portion; cutting a moving web to form successive signatures; and gripping the web with the first acceleration cylinder and the second acceleration cylinder at a gripping location with the first contacting segment and the second contacting segment to create a tension in the web as the web is cut by the cutting apparatus.

BRIEF DESCRIPTION OF THE DRAWINGS

Further features and advantages of the present invention will become apparent from the following detailed description taken in conjunction with the accompanying drawings, in which.

DETAILED DESCRIPTION OF PREFERRED EMBODIMENTS

In the web offset printing process, a continuous web of paper is transported through a printing press. One or more printing units apply ink to the web to repeatedly create a pattern, or impression, of text and images. A slitter may slit the web into ribbons, which may be longitudinally folded by a former. For the purposes of the present application, the term web also includes ribbons. A web conversion machine, such as a folder, may be used to cut the web into signatures and fold the signatures.

Many folders use driven belts or tapes to transport signatures from a cut cylinder to a next operation, such as signature deceleration or folding. These tapes contact the web before the signature is created and have a surface velocity higher than that of the web. The tapes are in firm contact with the web as the web is cut. A sliding friction between the tapes and the web may create tension in the web as the web is cut. The sliding friction may mark the web or smear the text and images printed on the web.

After a signature is created by the cut cylinder, the signature may be accelerated by the tapes from the velocity of the web to the surface velocity of the tapes. The difference between the velocity of the web and the velocity of the tapes, the velocity gain, may be up to 16%. The velocity gain may cause the signature to slip in relation to the tapes. The amount of slip may be dependent upon a number of variables, including tape contact pressure, thickness of the signature, whether the signature has a glossy or matte finish, the amount of ink and silicone coverage, or the condition of the tapes.

The rate of signature acceleration or deceleration may depend on the mass of the signature and on the normal force and coefficient of friction between the tapes and the signature. These factors may cause position variations in the signature when the signature reaches the next device, such as a fan or jaw cylinder. Slipping may cause position variations, which can include: signature-to-signature variation at a given press speed, variations due to press speed changes, and variations over time due to, for example, tape wear. Position variations may cause the following problems: reduced maximum allowable press speed, increased need for manual phase adjustments, machine damage, and press downtime due to jammed signatures. Such problems may be worse in variable cutoff applications and may become worse as press speeds increase.

Effects of varying friction may be controlled by minimizing a distance between the cut cylinder and the tapes and by adding an adjustable "S" wrap roll configuration.

Figure 1:
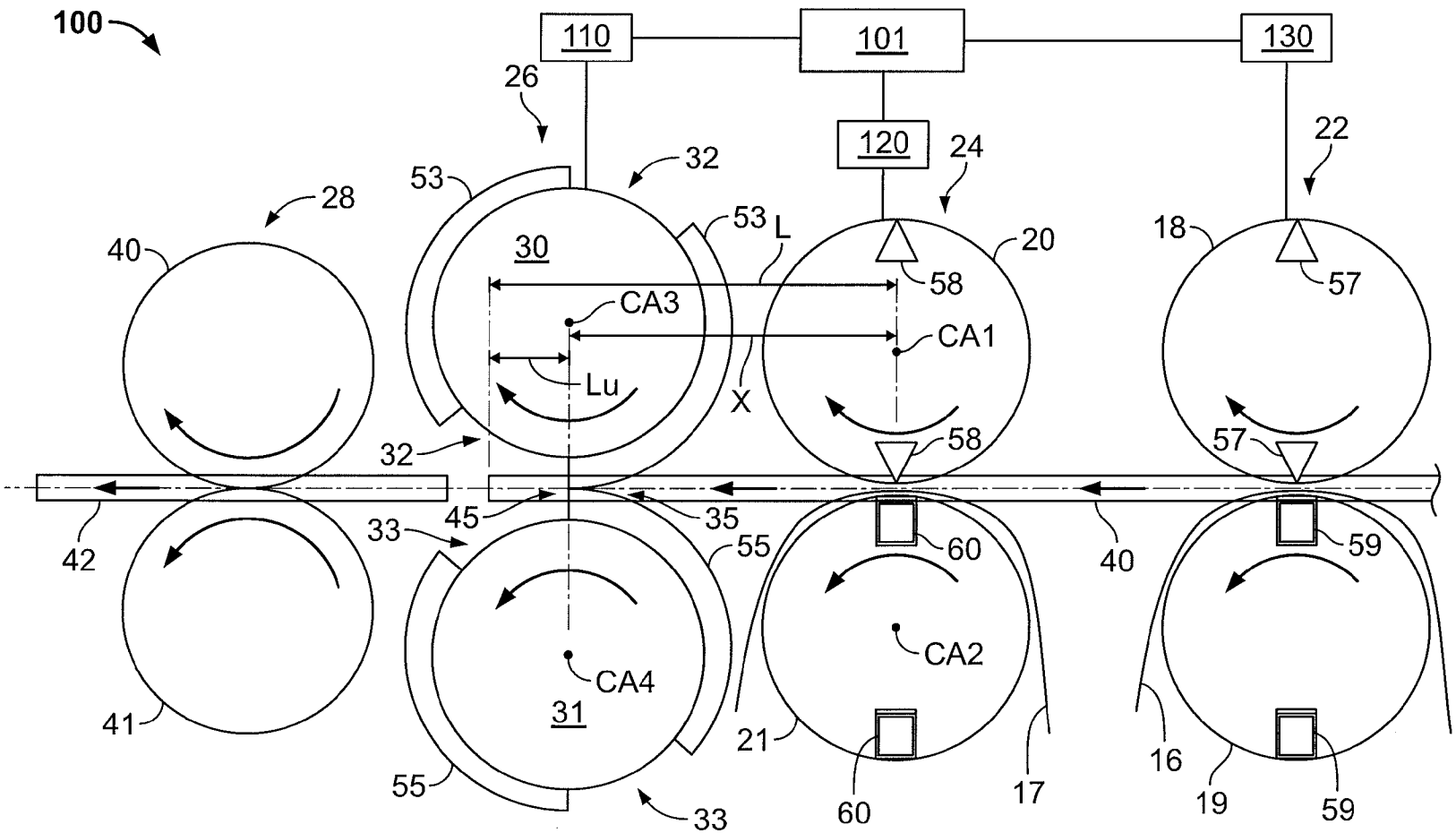
FIG. 1 shows a schematic side view of a portion of a printing press folder according to the present invention configured at a minimum web tension setting.
Figure 2:
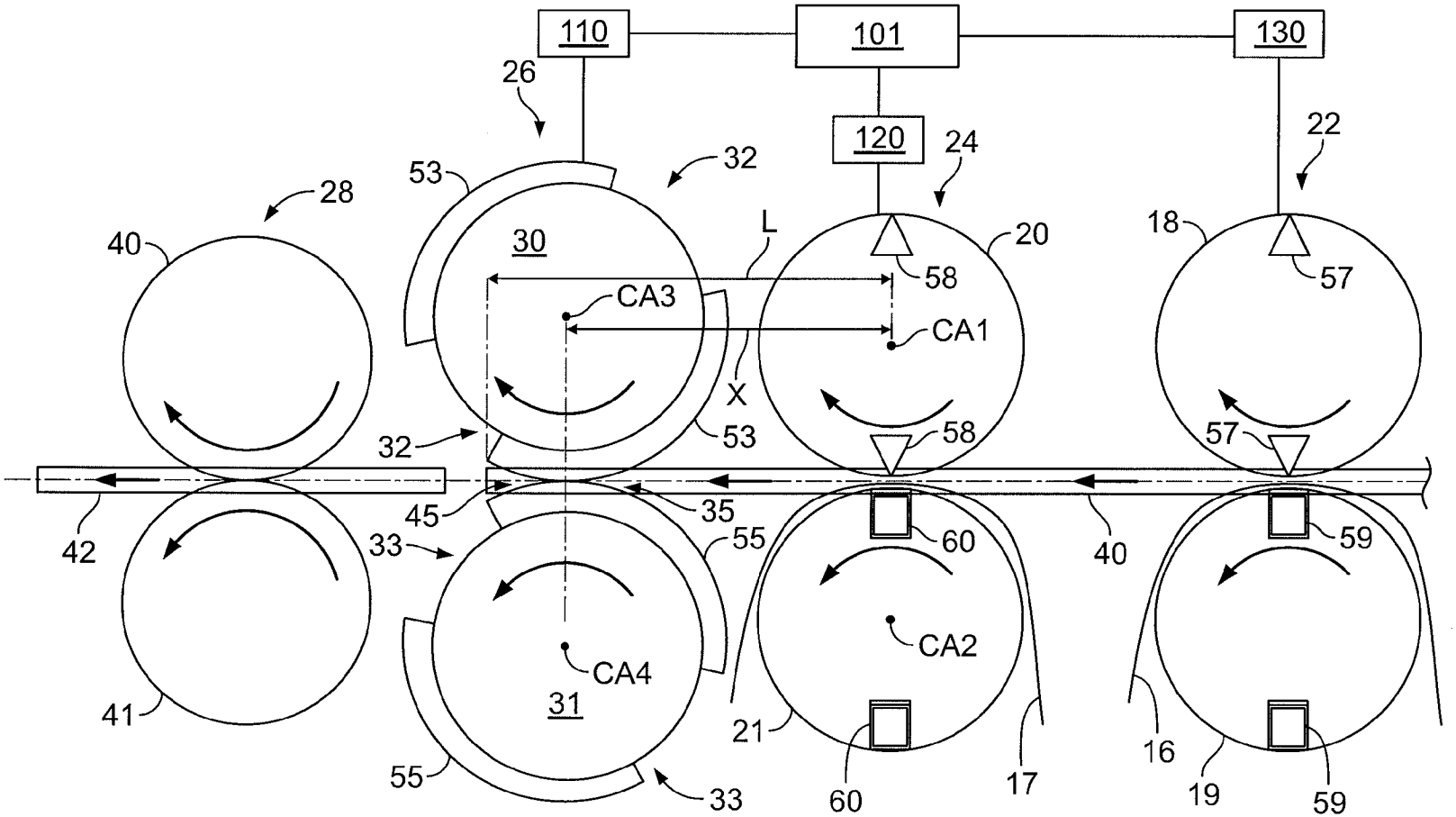
FIG. 2 shows a schematic side view of a portion of a printing press folder shown in FIG. 1 configured at a maximum tension setting.

FIGS. 1 and 2 show schematic side views of a portion of a printing press folder 100 according to an embodiment of the present invention. Folder 100 includes cutting pairs 22, 24, an acceleration pair 26 and a transport pair 28 and receives a printed web 40 traveling at a velocity V1, which folder 100 converts to signatures 42 of a length L.

Cutting pairs 22, 24 each include a respective cutting cylinder 18, 20 and a respective anvil cylinder 19, 21. Cutting cylinder 18 includes one or more segmented knives 57 that partially cut, or perforate, web 40 by contacting anvils 59 on anvil cylinder 19. Cutting cylinder 20 includes one or more knives 58 that finish the partial cuts created by knives 57, forming successive signatures 42 from web 40, by contacting anvils 60 on anvil cylinder 21. Knives 58 may also be segmented. Cylinders 18, 19 are rotated about respective center axes by a motor 130 and cylinders 20, 21 are rotated about respective center axes CA1, CA2 by a motor 120. Motors 120, 130 may be servomotors and may be controlled by a controller 101. Anvil cylinders 19, 21 may each be provided with a respective rubber tape 16, 17 mounted partially around the circumference thereof to control web 40 as web 40 is contacted by respective knives 57, 58. In one embodiment, rubber tapes 16, 17 may each travel along an endless loop that indexes to a new section once the current section of the respective rubber tape 16, 17 becomes worn. In another embodiment, rubber tapes 16, 17 may be integrated onto respective anvil cylinders 19, 21. In other embodiments of the present invention, rubber tapes 16, 17 are not used and knives 57, 58 directly contact anvil cylinders 19, 21.

Acceleration pair 26 includes two acceleration cylinders 30, 31 used to positively grip web 40 as web 40 is cut by cutting cylinder 20. Cylinders 30, 31 are rotated about respective center axes CA3, CA4 by a motor 110, which is controlled by controller 101. Motor 110 may be a servomotor. Outer surfaces of cylinders 30, 31 include respective contacting segments 53, 55 and respective relieved portions 32, 33. Contacting segments 53, 55 are circumferentially separated by relieved portions 32, 33 and contacting segments 53, 55 radially protrude from cylinders 30, 31 with respect to relieved portions 32, 33. Throughout each revolution of cylinders 30, 31 about respective center axes CA3, CA4, contacting segments 53, 55 come into contact with one another, directly or via web 40, to form a nip 35 to engage web 40 at a gripping location 45 between center axes CA3, CA4. Relieved portions 32, 33 allow cylinders 30, 31 to come in and out of contact with web 40 during each revolution about respective center axes CA3, CA4 of cylinders 30, 31. This allows cylinders 30, 31 to be phased by controller 101 so that cylinders 30, 31, via contacting segments 53, 55, contact web 40 a desired amount of time before web 40 is cutting by cutting cylinder 20. The amount of time cylinders 30, 31 grip web 40 before web 40 is cut by cutting cylinder 20 affects the amount of tension in web 40 as web 40 is cut by cutting cylinder 20. In a preferred embodiment, contacting segments 53, 55 may have a circumferential surface length that is approximately equal to length L of signatures 42.

In order for the tension in web 40 to be adjustable via phasing of acceleration cylinders 30, 31, respective axes CA3, CA4 of acceleration cylinders 30, 31 are separated from respective center axes CA1, CA2 of cutting cylinder 20 and anvil cylinder 21 a distance X which is less than length L of signatures 42. A range of adjustment of the tension of web 40 due to phasing of acceleration cylinders 30, 31 may be increased by increasing the difference between length L and distance X and the range of adjustment may be decreased by decreasing the difference between length L and distance X.

Cylinders 30, 31 including contacting segments 53, 55 and relieved portions 32, 33 may be formed by grinding cylindrical rolls or cylindrical sleeves that may be mounted on cylindrical rolls to desired diameters at circumferential locations so that the remaining circumferential portions of the rolls or sleeve that were not ground form contacting segments 53, 55 and circumferential portions the were ground form relieved portions 32, 33. Alternatively, contacting segments 53, 55 may each be one or more strips of material that are joined to surfaces of cylindrical rolls to form cylinders 30, 31 and relieved portions are the circumferential portions of the outer surfaces of cylinders 30, 31 that do not include the strips. Surfaces of contacting segments 53, 55 may be made of elastomeric materials or other materials suitable for the positive control of printed products.

In operation, the phase of the acceleration cylinders 30, 31 can be adjusted to control the tension in web 40. Acceleration cylinders 30, 31 are rotated so that contacting segments 53, 55 have a surface velocity V2 that is greater than the velocity V1 of web 40 as web 40 travels past cutting cylinder 20. When acceleration cylinders 30, 31 form nip 35 and grab web 40 at gripping location 45, web 40 is pulled with an increasing force. This force is proportional to the amount of time acceleration cylinders 30, 31 pull on web 40 before web 40 is cut by cutting cylinder 20 to form each signature 42 and the difference in surface velocity, the velocity gain, between surfaces of contacting segments 53, 55 and web 40. Thus, because cylinders 30, 31 include respective contacting segments 53, 55 and respective relieved portions 32, 33, cylinders 30, 31 may be phased to control the amount of time cylinders 30, 31 pull on web 40 before web 40 is cut by cutting cylinder 20. The amount of time cylinders 30, 31 pull on web 40 before web 40 is cut by cutting cylinder 20 is also dependent upon a distance X between cutting location 35 and gripping location 45.

FIG. 1 shows cylinders 30, 31 phased to grip web 40 at gripping location 45 and produce a minimum tension in web 40 in the direction of travel of web 40. Cylinders 30, 31 are phased so that contacting segments 53, 55 do not grab web 40 until cutting cylinder 20 is cutting web 40 to create a signature 42. A portion of web 40, an ungripped length Lu, will pass by gripping location 45 as respective relieved portions 32, 33 of cylinders 30, 31 are rotated past gripping location 45. Contacting segments 53, 55 are then rotated into gripping location 45 and cylinders 30, 31 grip web 40 just as web 40 is cut by cutting cylinder 20. Cylinders 30, 31 are rotated by motor 110 about respective axes CA3, CA4 so that contacting segments 53, 55 have a surface velocity V2 that is greater than velocity V1 of web 40. Because contacting segments 53, 55 travel at surface velocity V2 that is greater than velocity V1, cylinders 30, 31 attempt to increase velocity V1 of web 30 after web 40 is grabbed by cylinders 30, 31. However, forces on web 40 upstream of gripping location 45 provide resistance to this acceleration and the tangential forces exerted on web 40 caused by the friction of contacting segments 53, 55 with respect to web 40 create a tension in web 40. Because in FIG. 1 contacting segments 53, 55 only have a minimum time to apply tangential forces to web 40, a minimum tension is produced in web 40 by cylinders 30, 31.

After web 40 is cut by cutting cylinder 20 to form signature 42, acceleration cylinders 30, 31 may accelerate signature 42 to velocity V2. Signature 42 is then released from cylinders 30, 31 and passed to transport cylinders 40, 41. Transport cylinders 40, 41 may further accelerate signature 42 or may have a surface velocity equal to velocity V2 and simply pass signature 42 downstream for further processing. The acceleration of signatures 42 by acceleration cylinders 30, 31 allows a separation gap to be introduced in between successive signatures 42.

FIG. 2 shows cylinders 30, 31 phased to grip web 40 at gripping location 45 and produce a maximum tension in web 40 in the direction of travel of web 40. Cylinders 30, 31 are phased so that contacting segments 53, 55 grab web 40 as early as possible, just as a lead edge of web 40 is at gripping location 45. Cylinders 30, 31 are rotated by motor 110 so that contacting segments 53, 55 have a surface velocity V2 that is greater than velocity V1 of web 40. Because contacting segments 53, 55 travel at surface velocity V2 that is greater than velocity V1, cylinders 30, 31 attempt to increase velocity V1 of web 30 after web 40 is grabbed by cylinders 30, 31. However, forces on web 40 upstream of gripping location 45 provide resistance to this acceleration and the tangential forces exerted on web 40 caused by the friction of contacting segments 53, 55 with respect to web 40 create a tension in web 40. Because in FIG. 2 contacting segments 53, 55 have a maximum time to apply tangential forces to web 40, a maximum tension is produced in web 40 by cylinders 30, 31.

Folder 100 advantageously provides positive control of web 40 and signatures 42 during the signature create process without relying on a controlled slip to set the cut tension. Acceleration cylinders 30, 31 positively hold web 40 and create a tension in web 40 during cutting due to the velocity gain of the surfaces of contacting segments 53, 55 with respect to web 40. This tension is adjustable by adjusting the phasing of acceleration cylinders 30, 31 with respect to one another and web 40 so that web 40 is gripped by acceleration cylinders 30, 31 for a precise, adjustable time before web 40 is cut. The tension in web 40 is also adjustable by adjusting the surface velocity V2 of contacting segments 53, 55 with respect to the surface velocity V1 of web 40.

In one alternative embodiment, each acceleration cylinder 30, 31 may include only a single respective contacting segment 53, 55. In other alternative embodiments, each acceleration cylinder 30, 31 may include more than two respective contacting segments 53, 55.

Folder 100 may also be used in a variable cutoff printing press, with the phasing of acceleration cylinders 30, 31 being adjusted to accommodate changes in signatures length.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A printing press folder comprising:

a cutting apparatus cutting a moving web to form successive signatures, wherein said cutting separates each of the successive signatures from the web;

a first acceleration cylinder including a first contacting segment and a first relieved portion circumferentially adjacent to the first contacting segment, the first contacting segment radially protruding from the first acceleration cylinder with respect to the first relieved portion;

a second acceleration cylinder including a second contacting segment and a second relieved portion circumferentially adjacent to the second contacting segment, the second contacting segment radially protruding from the second acceleration cylinder with respect to the second relieved portion, the first acceleration cylinder and the second acceleration cylinder gripping the web at a gripping location with the first contacting segment and the second contacting segment as the web is cut by the cutting apparatus;

a motor rotating the first acceleration cylinder and the second acceleration cylinder so the first acceleration cylinder and the second acceleration cylinder have a phasing with respect to one another and the web; and a controller coupled to the motor, the controller varying a web tension as the web is cut by the cutting apparatus by controlling the phasing, said controlling the phasing including at least two modes as follows;

a first mode where leading edges of the first and second contacting segments contact the web at substantially the same time as the cutting apparatus cuts the web to create a minimal amount of tension in the web, and a second mode where leading edges of the first and second contacting segments contact the web significantly before the cutting apparatus cuts the web to create a larger amount of tension in the web.

2. The printing press folder as recited in claim 1 wherein the first contacting segment and the second contacting segment have a circumferential length equal to a length of one of the successive signatures.

3. The printing press folder recited in claim 1 wherein the first contacting segment and the second contacting segment form a nip at the gripping location to grip the web and the controller controls the phasing to control when the first contacting segment and the second contacting segment form the nip.

4. The printing press folder recited in claim 1 wherein the first acceleration cylinder rotates about a first center axis as the second acceleration cylinder rotates about a second center axis and the first relieved portion and second relieved portion allow the first acceleration cylinder to come in and out of contact with second acceleration cylinder at the gripping location, directly or via the web, at the gripping location, during each revolution of the first acceleration cylinder about the first center axis.

5. The printing press folder recited in claim 4 wherein the first acceleration cylinder is rotated so that the first contacting segment and the first relieved portion pass by the gripping location during each revolution about the first center axis, the second acceleration cylinder is rotated so that the second contacting segment and the second relieved portion pass by the gripping location during each revolution about the second center axis, the first acceleration cylinder and the second acceleration cylinder gripping the web as the first contacting segment and the second contacting segment pass by the gripping location, the first acceleration cylinder and the second acceleration cylinder not gripping the web as the first relieved portion and the second relieved portion pass by the gripping location.

6. The printing press folder as recited in claim 1 wherein the first contacting segment and second contacting segment have a surface velocity that is greater than a web velocity as the web travels past the cutting apparatus.

7. The printing press folder as recited in claim 1 wherein a distance between the gripping location and the cutting apparatus is changed to change web tension.

8. The printing press folder recited in claim 1 wherein the successive signatures include a first signature, the first contacting segment and the second contacting segment gripping the web while the web is cut to form the first signature and accelerating the first signature away from the cutting apparatus, the first contacting segment and the second contacting segment maintaining positive control over the first signature during the accelerating of the first signature.

9. The printing press folder recited in claim 8 wherein the first acceleration cylinder includes an additional first contacting segment and an additional first relieved portion circumferentially adjacent to the additional first contacting segment and the first contacting segment, the second acceleration cylinder includes an additional second contacting segment and an additional second relieved portion circumferentially adjacent to the additional second contacting segment and the second contacting segment, and the successive signatures include a second signature formed immediately after the first signature, the additional first contacting segment and the additional second contacting segment gripping the web while the web is cut to form the second signature and accelerating the second signature away from the cutting apparatus, the additional first contacting segment and the additional second contacting segment maintaining positive control over the second signature during the accelerating.

* * * * *